US007514632B2

(12) United States Patent
Lin

(10) Patent No.: US 7,514,632 B2
(45) Date of Patent: Apr. 7, 2009

(54) TRANSMISSION CABLE

(75) Inventor: Chen-Che Lin, Keelung (TW)

(73) Assignee: Transpower Technology Co., Ltd., Taipei County (TW)

( * ) Notice: Subject to any disclaimer, the term of this patent is extended or adjusted under 35 U.S.C. 154(b) by 0 days.

(21) Appl. No.: 11/780,844

(22) Filed: Jul. 20, 2007

(65) Prior Publication Data

US 2008/0078568 A1 Apr. 3, 2008

(30) Foreign Application Priority Data

Sep. 29, 2006 (TW) ..... 95217536 U

(51) Int. Cl.
*H01B 7/00* (2006.01)

(52) U.S. Cl. ..... 174/117 R; 174/117 F

(58) Field of Classification Search ..... 174/110 R, 174/113 R, 117 R, 117 F, 117 FF
See application file for complete search history.

(56) References Cited

U.S. PATENT DOCUMENTS 5,416,268 A * 5/1995 Ellis ..... 174/36
6,444,902 B1 * 9/2002 Tsao et al. ..... 174/36
6,844,500 B2 * 1/2005 Williams et al. ..... 174/110 R
2003/0141110 A1 * 7/2003 Jonsson ..... 175/44
2003/0146015 A1 * 8/2003 Tanaka ..... 174/117 F
2004/0026114 A1 * 2/2004 Hsieh ..... 174/117 F
2004/0154826 A1 * 8/2004 Tanaka ..... 174/117 F

* cited by examiner

*Primary Examiner*—William H Mayo, III
(74) *Attorney, Agent, or Firm*—Rosenber, Klein & Lee

(57) ABSTRACT

A transmission cable includes a plurality of transmission wires, an inner covering layer, at least one grounding wire, a conducting layer, and an outer covering layer. The plurality of transmission wires are traverse disposed in parallel to form at least one transmission wire layer. The inner covering layer wraps around the transmission wire layer. The grounding wire is disposed at one side of the inner covering layer. The conducting layer wraps around the inner covering layer and the grounding wire. The grounding wire is electrically connected with the inner surface of the conducting layer. The outer covering layer wraps around the conducting layer and forms a flat shape.

8 Claims, 3 Drawing Sheets

TRANSMISSION CABLE

BACKGROUND OF THE INVENTION

1. Field of the Invention

The present invention relates to a transmission cable. In particular, this invention relates to a flat transmission cable.

2. Description of the Related Art

Transmission cables usually are applied to a variety of electronic devices, such as connecting the communication devices (Internet server, telephone set), or connecting the peripherals (mouse, and keyboard).

Reference is made to FIG. 1. The transmission cable of the prior art includes a plurality of transmission wires, a conducting layer 73 and a covering layer 74. The plurality of transmission wires includes a plurality of power wires 71 and a plurality of signal wires 76. All wires are close to form a bundle. The conducting layer 73 wraps around the plurality of transmission wires, and the covering layer 74 wraps around the conducting layer 73. Thereby, the transmission cable has a circular-tube shape.

When the transmission cable is used, the circular-tube outline of the transmission cable is obviously disposed and is not neat. The operation environment is disordered. Moreover, the user may be tripped due to the transmission cable and the connection will be bad.

When the transmission cable is not used, it is not convenient for the user to receive the transmission cable due to the circular-tube outline. Even though the user rolls and receives the transmission cable, the dimension is large. It is inconvenient for the user to carry or store it.

Furthermore, the conducting layer 73 of the transmission cable has an electric-magnetic sheltering effect. In order to enhance the transmission quality, the electric-magnetic sheltering effect of the transmission cable must be improved.

SUMMARY OF THE INVENTION

One particular aspect of the present invention is to provide a transmission cable. It is convenient for the user to roll up and receive the transmission cable. The electric-magnetic sheltering effect and the ESD protection effect are improved.

The transmission cable includes a plurality of transmission wires, an inner covering layer, at least one grounding wire, a conducting layer, and an outer covering layer. The plurality of transmission wires are traverse disposed in parallel to form at least one transmission wire layer. The inner covering layer wraps around the transmission wire layer. The grounding wire is disposed at one side of the inner covering layer. The conducting layer wraps around the inner covering layer and the grounding wire. The grounding wire is electrically connected with the conducting layer. The outer covering layer wraps around the conducting layer and forms a flat shape.

Because the plurality of transmission wires are traverse disposed in parallel to form at least one transmission wire layer, its total height is decreased. Because the outer covering layer wraps around the conducting layer and forms a flat shape, the height of the transmission cable is reduced and it is convenient for the user to roll up and store the transmission cable.

Because the conducting layer wraps around the inner covering layer and the grounding wire, the electric-magnetic sheltering effect of the transmission cable is improved.

Because the grounding wire is electrically connected with the conducting layer, the ESD protection effect of the transmission cable is improved.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
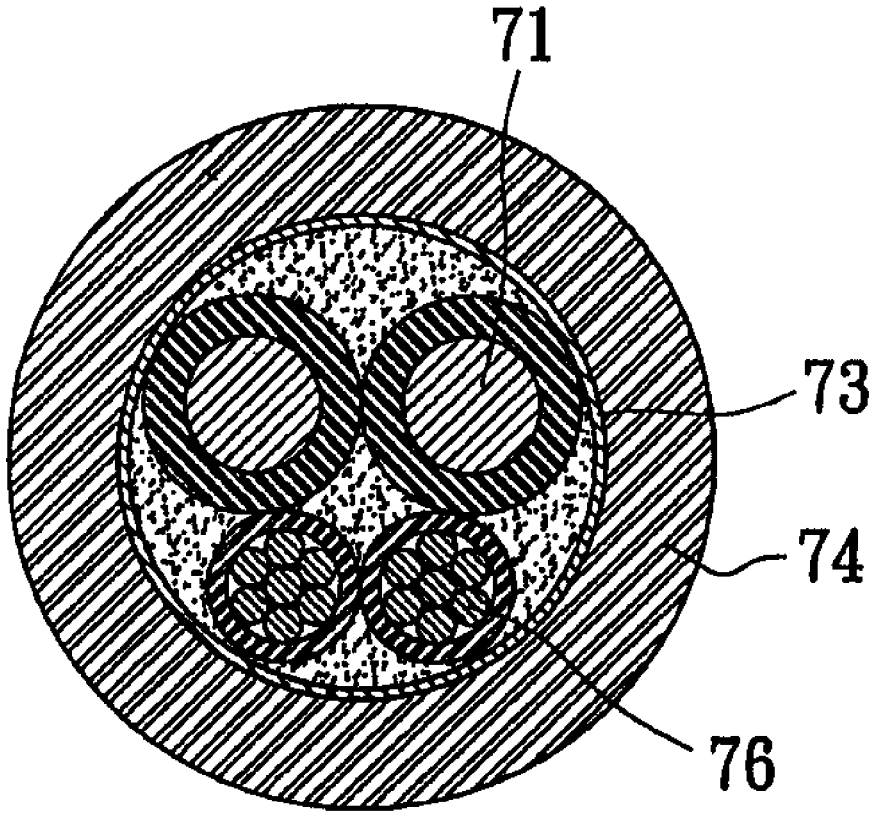
FIG. 1 PRIOR ART
FIG. 1 is a cross-sectional view of the transmission cable of the prior art.
Figure 2:
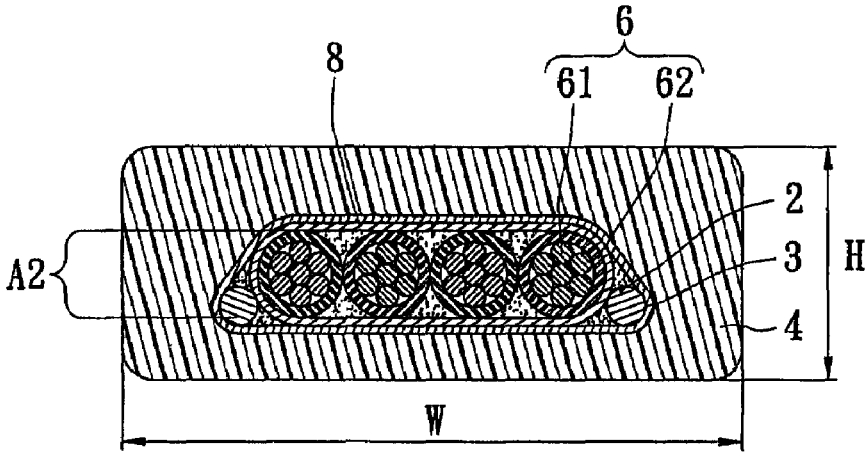
FIG. 2 is a cross-sectional view of the transmission cable of the first embodiment of the present invention.

Reference is made to FIG. 2, which shows the transmission cable of the first embodiment of the present invention. The transmission cable includes a plurality of transmission wires, an inner covering layer 8, at least one grounding wire 2, a conducting layer 3, and an outer covering layer 4.

In the first embodiment, the transmission wires include a plurality of signal wires 6. The plurality of transmission wires are traverse disposed in parallel to form at least one transmission wire layer A2 to reduce the total height. Each of the transmission wires include a conducting wire 61 and an insulating layer 62, and the insulating layer 62 wraps around the conducting wire 61.

The inner covering layer 8 is made of an insulating material. The inner covering layer 8 wraps around the transmission wire layer A2 to hold the transmission wires and form a single piece.

The grounding wire 2 is made of a conducting material. The grounding wire 2 is disposed at one side of the inner covering layer 8. In this first embodiment, there are two grounding wires 2. The two grounding wires 2 are respectively disposed at two sides of the inner covering layer 8.

The conducting layer 3 is made of a metal material, such as aluminum foil. The conducting layer 3 wraps around the inner covering layer 8 and the grounding wire 2. The grounding wire 2 is electrically connected with the inner surface of the conducting layer 3 to increase the grounding effect.

The outer covering layer 4 is made of an insulating material. The outer covering layer 4 wraps around the conducting layer and forms a flat shape. This means that the width W of the outer covering layer 4 is larger than the height H of the outer covering layer 4. Therefore, the height H of the transmission cable of the present invention is small than the height of the transmission cable of the prior art, and it is easy to roll up and store the transmission cable.

Figure 3:
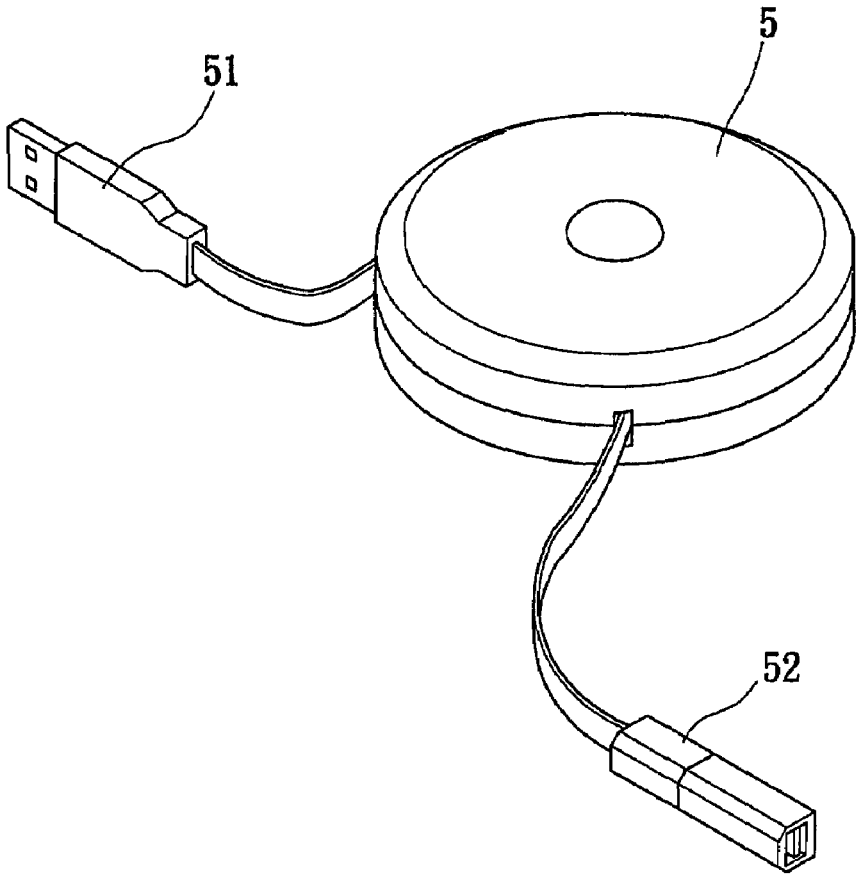
FIG. 3 is a schematic diagram of the transmission cable of the present invention being in operating status.

When the transmission cable is used, it is easy to put the transmission cable in order and position the transmission cable due to its flat outline. As shown in FIG. 3, part of the transmission cable can be received in a wire-rolling box 5 so that the operation environment is nest, and the problem of the user being tripped by the transmission cable is overcome.

Therefore, the user and the electronic device connected with the transmission cable are not affected.

When the transmission cable is not used, the transmission cable can be received in a wire-rolling box 5 to reduce the required space of the transmission cable, as shown in FIG. 3. It is convenient for the user to carry and store the transmission cable.

Two ends of the transmission cable individually are connected with the first connector 51 and the second connector 52. The grounding wire 2 is electrically connected with the conducting layer 3 so that conducting layer 3 is electrically connected with the first connector 51 and/or the second connector 52 via the grounding wire 2. Thereby, the electric-magnetic sheltering effect of the transmission cable is improved and the transmission quality is improved.

Figure 4:
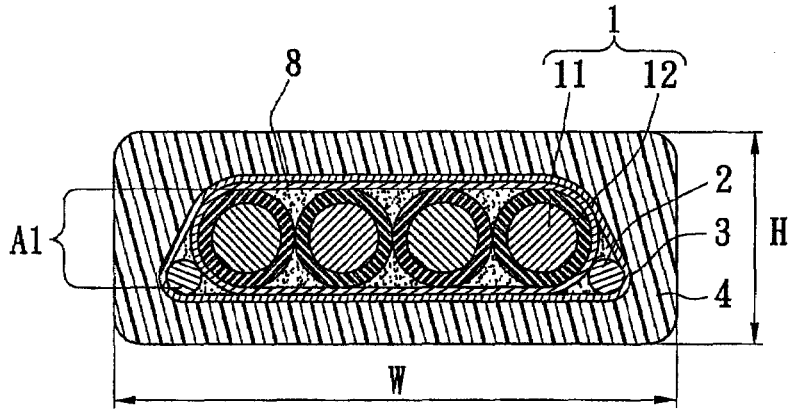
FIG. 4 is a cross-sectional view of the transmission cable of the second embodiment of the present invention.

Reference is made to FIG. 4, which shows the transmission cable of the second embodiment of the present invention. The difference between the second embodiment and the first embodiment is the transmission wires. In the second embodiment, the transmission wires include a plurality of power wires 1. The plurality of transmission wires are traverse disposed in parallel to form at least one transmission wire layer A1 to reduce the total height. Each of the transmission wires include a conducting wire 11 and an insulating layer 12, and the insulating layer 12 wraps around the conducting wire 11.

Figure 5:
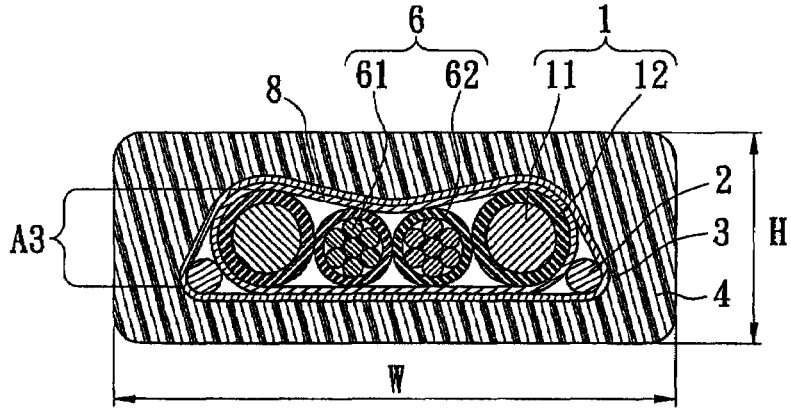
FIG. 5 is a cross-sectional view of the transmission cable of the third embodiment of the present invention.

Reference is made to FIG. 5, which shows the transmission cable of the third embodiment of the present invention. The difference between the third embodiment and the first embodiment is the transmission wires. In the third embodiment, the transmission wires include a plurality of signal wires 6 (the signal wire in the first embodiment) and a plurality of power wires 1 located at outside of the signal wires 6 (the power wire in the second embodiment). The plurality of transmission wires are traverse disposed in parallel to form at least one transmission wire layer A3 to reduce the total height.

Figure 6:
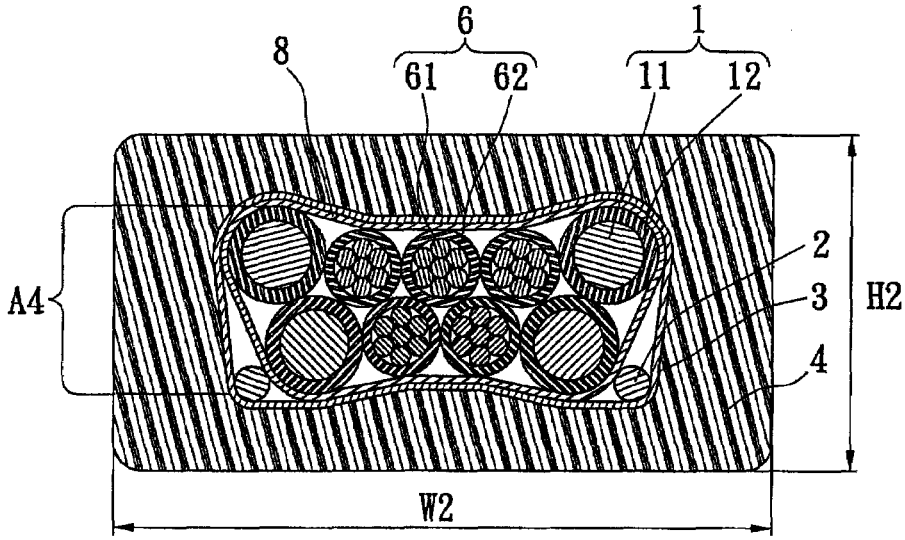
FIG. 6 is a cross-sectional view of the transmission cable of the fourth embodiment of the present invention.

Reference is made to FIG. 6, which shows the transmission cable of the fourth embodiment of the present invention. The difference between the fourth embodiment and the first embodiment is the transmission wires. In the fourth embodiment, the plurality of transmission wires are traverse disposed in parallel to form two rows of the transmission wire layers A4 to reduce the total height. The inner covering layer 8 wraps around the transmission wire layers A4. The outer covering layer 4 wraps around the conducting layer 3 and forms a flat shape. This means that the width W2 of the outer covering layer 4 is larger than the height H2 of the outer covering layer 4.

The present invention has the following characteristics:

1. Because the plurality of transmission wires are traverse disposed in parallel to form at least one transmission wire layer to reduce the total height, and the outer covering layer wraps around the conducting layer and forms a flat shape. The height of the transmission cable is reduced and it is convenient to roll up the transmission cable. Thereby, it is convenient to put the transmission cable in order, carry the transmission cable, and store the transmission cable.

2. Because the grounding wire is electrically connected with the inner surface of the conducting layer to increase the grounding effect, the ESD protection effect of the transmission cable is improved. The electric-magnetic sheltering effect of the transmission cable is also improved to enhance the transmission quality due to the conducting layer.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A transmission cable, comprising:

a plurality of transmission wires traverse disposed in parallel to form at least one transmission wire layer;

an inner covering layer wrapping around the transmission wire layer and spatially separated from said plurality of transmission wires by an insulating layer surrounding said transmission wires;

at least one grounding wire disposed at one side of the inner covering layer;

a conducting layer wrapping around the inner covering layer and the grounding wire, wherein the grounding wire is electrically connected with the conducting layer; and an outer covering layer wrapping around the conducting layer and forming a flat shape.

2. The transmission cable as claimed in claim 1, wherein the plurality of transmission wires includes a plurality of power wires.

3. The transmission cable as claimed in claim 1, wherein the plurality of transmission wires includes a plurality of signal wires.

4. The transmission cable as claimed in claim 1, wherein the plurality of transmission wires includes a plurality of power wires and a plurality of signal wires.

5. The transmission cable as claimed in claim 1, wherein each of the transmission wires includes a conducting wire and an insulating layer, and the insulating layer wraps around the conducting wire.

6. The transmission cable as claimed in claim 1, wherein there are two grounding wires, and the two grounding wires are respectively disposed at two sides of the inner covering layer.

7. The transmission cable as claimed in claim 1, wherein the conducting layer is an aluminum foil.

8. The transmission cable as claimed in claim 1, wherein the width of the outer covering layer is larger than the height of the outer covering layer.

* * * * *